US008146714B2

(12) United States Patent
Blasko

(10) Patent No.: US 8,146,714 B2
(45) Date of Patent: Apr. 3, 2012

(54) ELEVATOR SYSTEM INCLUDING REGENERATIVE DRIVE AND RESCUE OPERATION CIRCUIT FOR NORMAL AND POWER FAILURE CONDITIONS

(75) Inventor: Vladimir Blasko, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 456 days.

(21) Appl. No.: 12/519,282

(22) PCT Filed: Dec. 14, 2006

(86) PCT No.: PCT/US2006/047698

§ 371 (c)(1),
(2), (4) Date: Jun. 15, 2009

(87) PCT Pub. No.: WO2008/076095

PCT Pub. Date: Jun. 26, 2008

(65) Prior Publication Data

US 2010/0006378 A1 Jan. 14, 2010

(51) Int. Cl.
*B66B 1/06* (2006.01)

(52) U.S. Cl. ..... 187/290; 187/393

(58) Field of Classification Search ..... 187/247, 187/248, 284, 288–291, 296, 297, 391–393; 307/66, 68, 69; 318/376, 799–815
See application file for complete search history.

(56) References Cited

U.S. PATENT DOCUMENTS 3,902,573 A * 9/1975 Grove et al. ..... 187/290
4,503,940 A * 3/1985 Watanabe ..... 187/290
4,506,766 A * 3/1985 Watanabe ..... 187/290
5,058,710 A 10/1991 Iwasa
5,285,029 A * 2/1994 Araki ..... 187/290
5,893,432 A * 4/1999 Nguyen et al. ..... 187/290
6,264,005 B1 * 7/2001 Kang et al. ..... 187/290
6,315,081 B1 11/2001 Yeo
6,439,348 B2 8/2002 Tajima et al.
6,827,182 B2 * 12/2004 Araki ..... 187/290
7,275,622 B2 * 10/2007 Hall et al. ..... 187/290
7,525,622 B2 * 4/2009 Yang et al. ..... 349/129
7,540,355 B2 * 6/2009 Harkonen ..... 187/290
7,549,515 B2 * 6/2009 Tegtmeier et al. ..... 187/288

(Continued)

FOREIGN PATENT DOCUMENTS

CN 88100162 A 7/1988

(Continued)

OTHER PUBLICATIONS

PCT International Search Report and Written Opinion, Sep. 15, 2008, 7 pages.

(Continued)

*Primary Examiner* — Anthony Salata

(74) *Attorney, Agent, or Firm* — Kinney & Lange, P.A.

(57) ABSTRACT

A system continuously drives an elevator hoist motor during normal and power failure conditions. A regenerative drive delivers power from a main power supply to the hoist motor during normal operation. A rescue operation circuit includes a backup power supply and is operable in the event of a failure of the main power supply to disconnect the regenerative drive from the main power supply and connect the back up power supply to the regenerative drive to provide substantially uninterrupted power to the hoist motor.

24 Claims, 3 Drawing Sheets

U.S. PATENT DOCUMENTS

| | | | | |
|---|---|---|---|---|
| 2001/0013447 | A1 | 8/2001 | Araki et al. | |
| 2004/0035646 | A1 | 2/2004 | Araki | |
| 2005/0006182 | A1 | 1/2005 | Hall et al. | |
| 2006/0266588 | A1 | 11/2006 | Wang | |
| 2010/0044160 | A1 * | 2/2010 | Agirman et al. | 187/290 |

FOREIGN PATENT DOCUMENTS

| | | | | |
|---|---|---|---|---|
| JP | 01315293 | A | * | 12/1989 |
| JP | 04045086 | A | * | 2/1992 |
| JP | 04277182 | A | * | 10/1992 |
| JP | 09240950 | | | 9/1997 |
| JP | 2002538061 | A | | 11/2002 |
| KR | 1020040035870 | | | 4/2004 |

OTHER PUBLICATIONS

Korean Office Action mailed Dec. 9, 2010.
State Intellectual Property Office, P.R. China, First Office Action, Apr. 25, 2011, 6 pages.

* cited by examiner

ELEVATOR SYSTEM INCLUDING REGENERATIVE DRIVE AND RESCUE OPERATION CIRCUIT FOR NORMAL AND POWER FAILURE CONDITIONS

BACKGROUND OF THE INVENTION

The present invention relates to the field of power systems. In particular, the present invention relates to an elevator power system for continuously driving an elevator system during normal and power failure conditions.

An elevator drive system is typically designed to operate over a specific input voltage range from a power source. The components of the drive have voltage and current ratings that allow the drive to continuously operate while the power supply remains within the designed input voltage range. However, in certain markets the utility network is less reliable, and utility voltage sags, brownout conditions (i.e., voltage conditions below the tolerance band of the drive) and/or power loss conditions are prevalent. When utility voltage sags occur, the drive draws more current from the power supply to maintain uniform power to the hoist motor. In conventional systems, when excess current is being drawn from the power supply, the drive will shut down to avoid damaging the components of the drive.

When a power sag or power loss occurs, the elevator may become stalled between floors in the elevator hoistway until the power supply returns to the nominal operating voltage range. In conventional systems, passengers in the elevator may be trapped until a maintenance worker is able to release a brake for controlling cab movement upwardly or downwardly to allow the elevator to move to the closest floor. More recently, elevator systems employing automatic rescue operation have been introduced. These elevator systems include electrical energy storage devices that are controlled after power failure to provide power to move the elevator to the next floor for passenger disembarkation. However, many current automatic rescue operation systems are complex and expensive to implement, and may provide unreliable power to the elevator drive after a power failure.

BRIEF SUMMARY OF THE INVENTION

The subject invention is directed to a system for continuously driving an elevator hoist motor during normal and power failure conditions. A regenerative drive delivers power from a main power supply to the hoist motor during normal operation. A rescue operation circuit includes a backup power supply and is operable, in the event of a failure of the main power supply, to disconnect the regenerative drive from the main power supply and connect the backup power supply to the regenerative drive to provide substantially uninterrupted power to the hoist motor.

DETAILED DESCRIPTION

Figure 1:
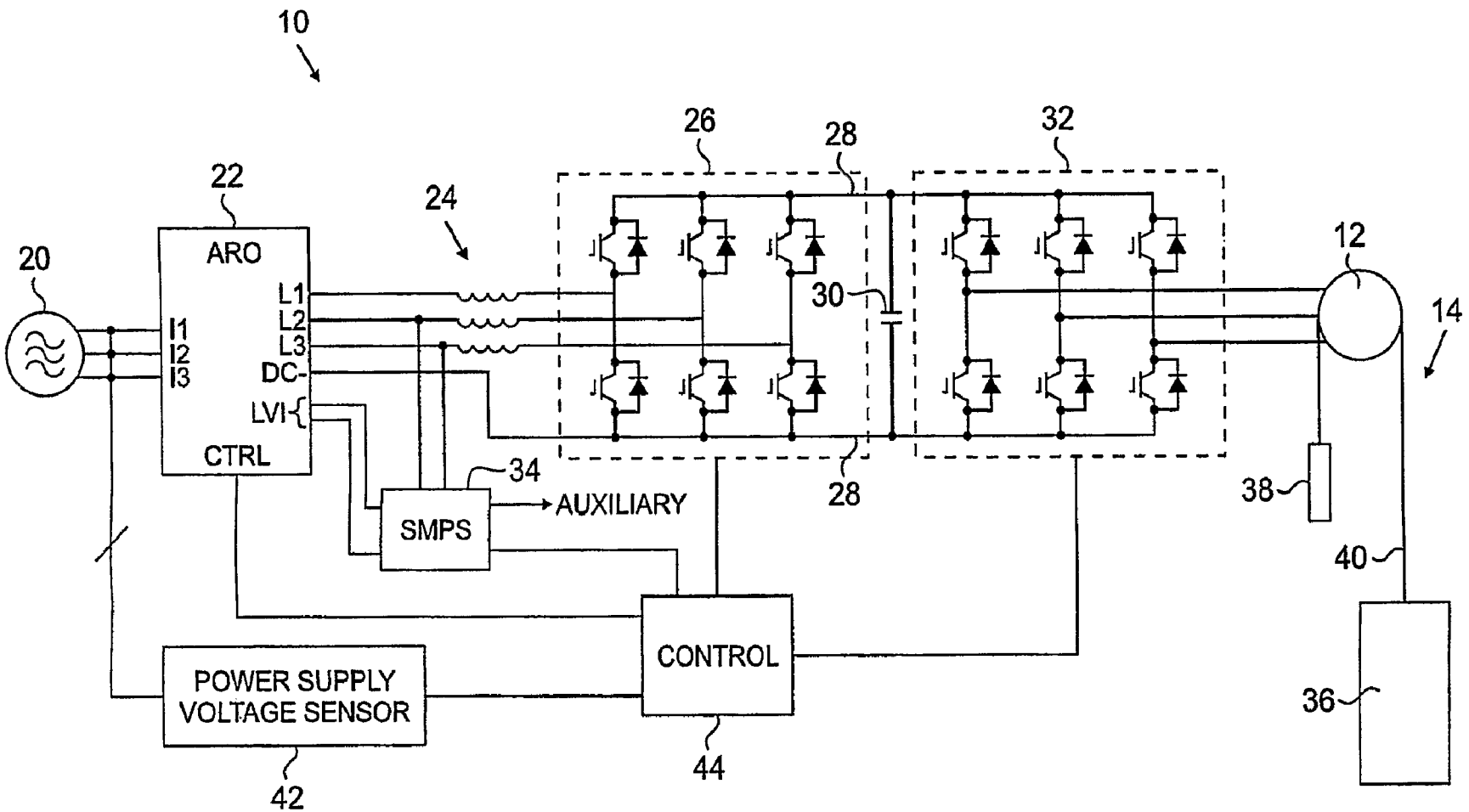
FIG. 1 is a schematic view of a power system for driving an elevator hoist motor.

FIG. 1 is a schematic view of power system 10 for driving hoist motor 12 of elevator 14 including main power supply 20 and an elevator drive system including rescue operation circuit 22, line reactors 24, power converter 26, power bus 28, smoothing capacitor 30, power inverter 32, and switch mode power supply (SMPS) 34. Main power supply 20 may be electricity supplied from an electrical utility, such as a commercial power source. Elevator 14 includes elevator car 36 and counterweight 38 that are connected through roping 40 to hoist motor 12. Power supply voltage sensor 42 is connected across the three phases of main power supply 20 to monitor and measure the voltage of main power supply 20. Control block 44 is connected to provide signals to and/or receive signals from rescue operation circuit 22, power converter 26, power inverter 32, and power supply voltage sensor 42.

As will be described herein, power system 10 is configured to provide substantially uninterrupted power during normal and power failure conditions to drive hoist motor 12 and other elevator systems. In certain markets the utility network is less reliable; persistent utility voltage sags, brownout conditions, and/or power loss conditions are prevalent. Power system 10 includes rescue operation circuit 22 to allow for continuous operation of hoist motor 12 at normal operating conditions during these periods of irregularity by switching from the failing main power supply to a backup power supply. While the following description is directed to driving an elevator hoist motor, it will be appreciated that rescue operation circuit 22 may be employed to provide continuous power to any type of load.

Rescue operation circuit 22 includes three inputs I1, I2, and I3 that are each connected to one of the three phases of main power supply 20. Output lines L1, L2, and L3 of rescue operation circuit 22 are connected to power converter 26 through line reactors 24. The common node of power converter 26, power bus 28, and power inverter 32 is connected to input DC−, and power is provided to SMPS 34 from rescue operation circuit 22 via low voltage lines LVI. SMPS 34 is also connected to output lines L2 and L3 to receive one phase of the high voltage power output from of rescue operation circuit 22. It should be noted that SMPS 34 can be connected to any two of lines L1, L2, and L3 to receive one phase of high voltage power output. SMPS 34 provides power to auxiliary systems and to control block 44. Control block 44 controls operation of rescue operation circuit 22 by exchanging signals on the CTRL connection on rescue operation circuit 22.

In operation, power supply voltage sensor 42 continuously monitors the voltage from main power supply 20 and provides a signal related to the measured voltage to control block 44. Control block 44 then compares the measured voltage of main power supply 20 to a stored normal operating range for power system 10 (e.g., within 10% of normal voltage). If the measured voltage from main power supply 20 is within the normal operating range, control block 44 sends a signal to rescue operation circuit 22 to provide the power from main power supply 20 to power converter 26. Line reactors 24 are connected between rescue operation circuit 22 and power converter 26 to control the current passed between rescue operation circuit 22 and power converter 26.

If the measured voltage from main power supply 20 falls below the normal operating range, control block 44 sends a signal to rescue operation circuit 22 to disconnect main power supply 20 from power converter 26 and connect a backup power supply (e.g., a secondary battery) included in rescue operation circuit 22 to power converter 26. As will be described in more detail herein, rescue operation circuit 22 provides substantially uninterrupted power to power converter 26 after a drop in the voltage of main power supply 20 is detected. During the transition from main power supply 20 to the backup power supply, SMPS 34 (which is also connected to the backup power supply) keeps control and auxiliary components of power system 10 running to ensure fast switching and minimal delay from main to backup power. When the measured voltage returns to the normal operating range, control block 44 may send another signal to rescue operation circuit 22 that disconnects the backup power supply and reconnects main power supply 20 to power converter 26. Exemplary embodiments of rescue operation circuit 22 will be shown and described with regard to FIGS. 2 and 3.

Power converter 26 and power inverter 32 are connected by power bus 28. Smoothing capacitor 30 is connected across power bus 28. Power converter 26 may be a three-phase power inverter that is operable to convert three-phase AC power from main power supply 20 to DC power. In one embodiment, power converter 26 comprises a plurality of power transistor circuits including parallel-connected transistors and diodes. The DC output power is provided by power converter 26 on power bus 28. Smoothing capacitor 30 smoothes the rectified power provided by power converter 26 on DC power bus 28. Power converter 26 is also operable to invert power on power bus 28 to be returned to main power supply 20. This regenerative configuration reduces the demand on main power supply 20. It is important to note that while main power supply 20 is shown as a three-phase AC power source, power system 10 may be adapted to receive power from any type of power source, including (but not limited to) a single-phase AC power source and a DC power source.

Power inverter 32 may be a three-phase power inverter that is operable to invert DC power from power bus 28 to three-phase AC power. Power inverter 32 may comprise a plurality of power transistor circuits including parallel-connected transistors and diodes. Power inverter 32 delivers the three-phase power to hoist motor 12 at the outputs of power inverter 32. In addition, power inverter 32 is operable to rectify power that is generated when elevator 14 drives hoist motor 12. For example, if hoist motor 12 is generating power, power inverter 32 converts the generated power and provides it to power bus 28. Smoothing capacitor 30 smoothes the converted power provided by power inverter 32 on power bus 28. In an alternative embodiment, power inverter 32 is a single-phase power inverter that is operable to invert DC power from power bus 28 to single-phase AC power for delivery to hoist motor 12.

Hoist motor 12 controls the speed and direction of movement between elevator car 36 and counterweight 38. The power required to drive hoist motor 12 varies with the acceleration and direction of elevator 14, as well as the load in elevator car 36. For example, if elevator car 36 is being accelerated, run up with a load greater than the weight of counterweight 38 (i.e., heavy load), or run down with a load less than the weight of counterweight 38 (i.e., light load), a maximal amount of power is required to drive hoist motor 12. If elevator 14 is leveling or running at a fixed speed with a balanced load, it may be using a lesser amount of power. If elevator car 36 is being decelerated, running down with a heavy load, or running up with a light load, elevator car 36 drives hoist motor 12. In this case, hoist motor 12 generates power that is converted to DC power by power inverter 32. The converted DC power may be returned to main power supply 20 and/or dissipated in a dynamic brake resistor connected across power bus 28 (not shown). Thus, because power may be generated by hoist motor 12 and returned to main power supply 20 during light load conditions, the assembly including line reactors 24, power converter 26, power bus 28, smoothing capacitor 30, and power inverter 32 is often referred to as a regenerative drive.

It should be noted that while a single hoist motor 12 is shown connected to power system 10, power system 10 may be modified to power multiple hoist motors 12. For example, a plurality of power inverters 30 may be connected in parallel across power bus 28 to provide power to a plurality of hoist motors 12. As another example, a plurality of drive systems (including line reactors 24, power converter 26, power bus 28, smoothing capacitor 30, and power inverter 32) may be connected in parallel to rescue operation circuit 22 such that each drive system provides power to a hoist motor 12.

Power system 10 may also provide power to other electrical systems, such as auxiliary systems (e.g., machine fans, lighting and outlets of elevator car 36, and safety chains), and control systems (e.g., elevator system control boards, elevator position reference system, and passenger identification systems). During normal operation, SMPS 34 receives power from high voltage lines L2 and L3 via rescue operation circuit 22 and provides this power to the auxiliary and control systems. SMPS 34 is also connected to the backup power supply in rescue operation circuit 22 via low voltage lines LVI. The power from the backup power supply is maintained in standby mode while power system 10 is under normal operating conditions. In the event of a power failure, SMPS 34 switches to receive power from the backup power supply in rescue operation circuit 22 to continuously power the drive control system and the auxiliary systems while the regenerative drive is switched from main power supply 20 to the backup power supply. This allows for substantially uninterrupted service of the elevator system.

Figure 2:
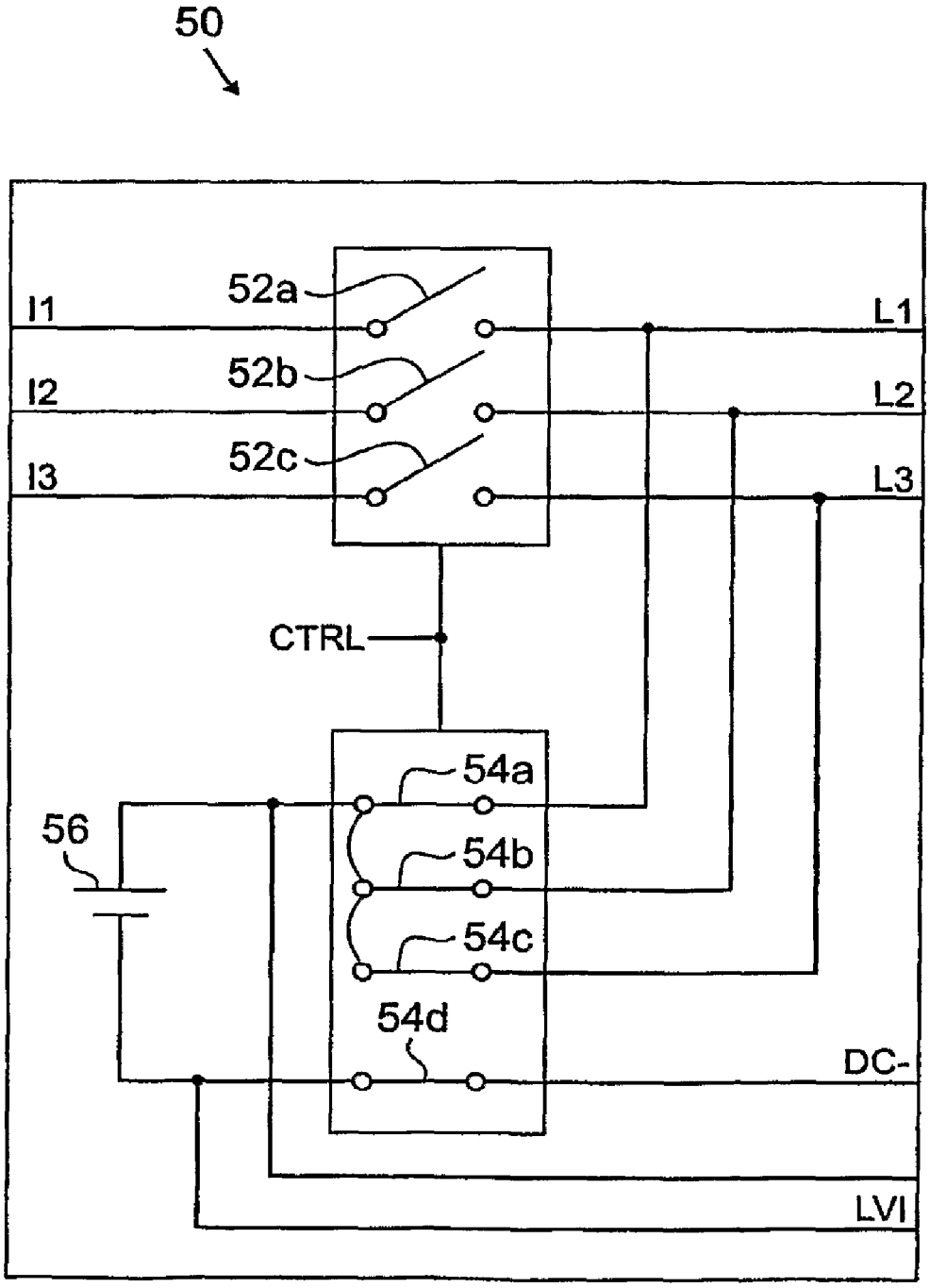
FIG. 2 is a schematic view of a three-phase bridge rescue operation circuit for switching from a main power supply to a backup power supply.

FIG. 2 is a schematic view of rescue operation circuit 50 according to an embodiment of the present invention. Rescue operation circuit 50 is an example of a circuit that may be used for rescue operation circuit 22 shown in FIG. 1. Rescue operation circuit 50 includes main power switches 52*a*, 52*b*, and 52*c*, backup power switches 54*a*, 54*b*, 54*c*, and 54*d*, and battery 56. Main power relay switch 52*a* is connected between input I1 and output line L1, main power relay switch 52*b* is connected between input I2 and output line L2, and main power relay switch 52*c* is connected between input I3 and output line L3. Backup power switches 54*a*, 54*b*, and 54*c* are connected between the positive pole of battery 56 and output lines L1, L2, and L3, respectively, and backup power relay switch 54*d* is connected between the negative pole of battery 56 and the common node of the regenerative drive (DC−). Backup power switches 54*a*-54*d* are arranged to form a three-phase bridge across output lines L1, L2, and L3. The low voltage inputs (LVI) of SMPS 34 are also connected across battery 56.

It should be noted that switches 52*a*-52*c* and 54*a*-54*d* are merely for purposes of concisely illustrating the connectivity and interaction of rescue operation circuit 50 and power system 10, and in actual implementation these switches may be any devices that facilitate controllable connection with the components of rescue operation circuit 50, including relay switches, transistors, and appropriately sized DC/DC converters It should also be noted that while a single battery 56 is shown, rescue operation circuit 50 may include any type or configuration of backup power supply, including a plurality of batteries connected in series, supercapacitors, or other energy storage devices.

If the measured voltage of main power supply 20 is within the normal operating range of power system 10, control block 40 provides a signal to rescue operation circuit 50 via line CTRL that simultaneously closes main power switches 52*a*-52*c* and opens backup power switches 54*a*-54*d*. This connects the three phases of main power supply 20 on inputs I1, I2, and I3 to output lines L1, L2, and L3, respectively. As a result, power system 10 (FIG. 1) is powered by main power supply 20 during normal operating conditions.

If the measured voltage of main power supply 20 drops below the normal operating range of power system 10, control block 40 provides a signal to rescue operation circuit 50 via line CTRL that simultaneously opens main power switches 52*a*-52*c* and closes backup power switches 54*a*-54*d*. This connects the positive pole of battery 56 to all three output lines L1, L2, and L3 and the negative pole of battery 56 to the common node DC− of the regenerative drive. SMPS 34 is powered via lines LVI from battery 56 to continuously power the drive control system and the auxiliary systems during the transition from main power supply 20 to battery 56. After the transition, power converter 26 acts as a unit having three bi-directional boost converters connected in parallel to provide stepped-up DC power from battery 56 to power bus 28. The configuration shown is capable of providing DC power from battery 56 on power bus 28 that is as much as three to five times the voltage of battery 56.

The transition from main power supply 20 to battery 56 happens quickly, so power system 10 can operate substantially uninterrupted to provide rescue operation to deliver passengers on elevator 14 to the next closest floor after power failure. In addition, elevator 14 can run at a relatively high speed during rescue operation (up to 50% of normal operating speed), allowing passengers to exit elevator 14 expeditiously after failure of main power supply 20. Furthermore, because the power provided on power bus 28 from battery 56 is relatively high, elevator 14 may continue operating even if elevator car 36 is heavily unbalanced.

Figure 3:
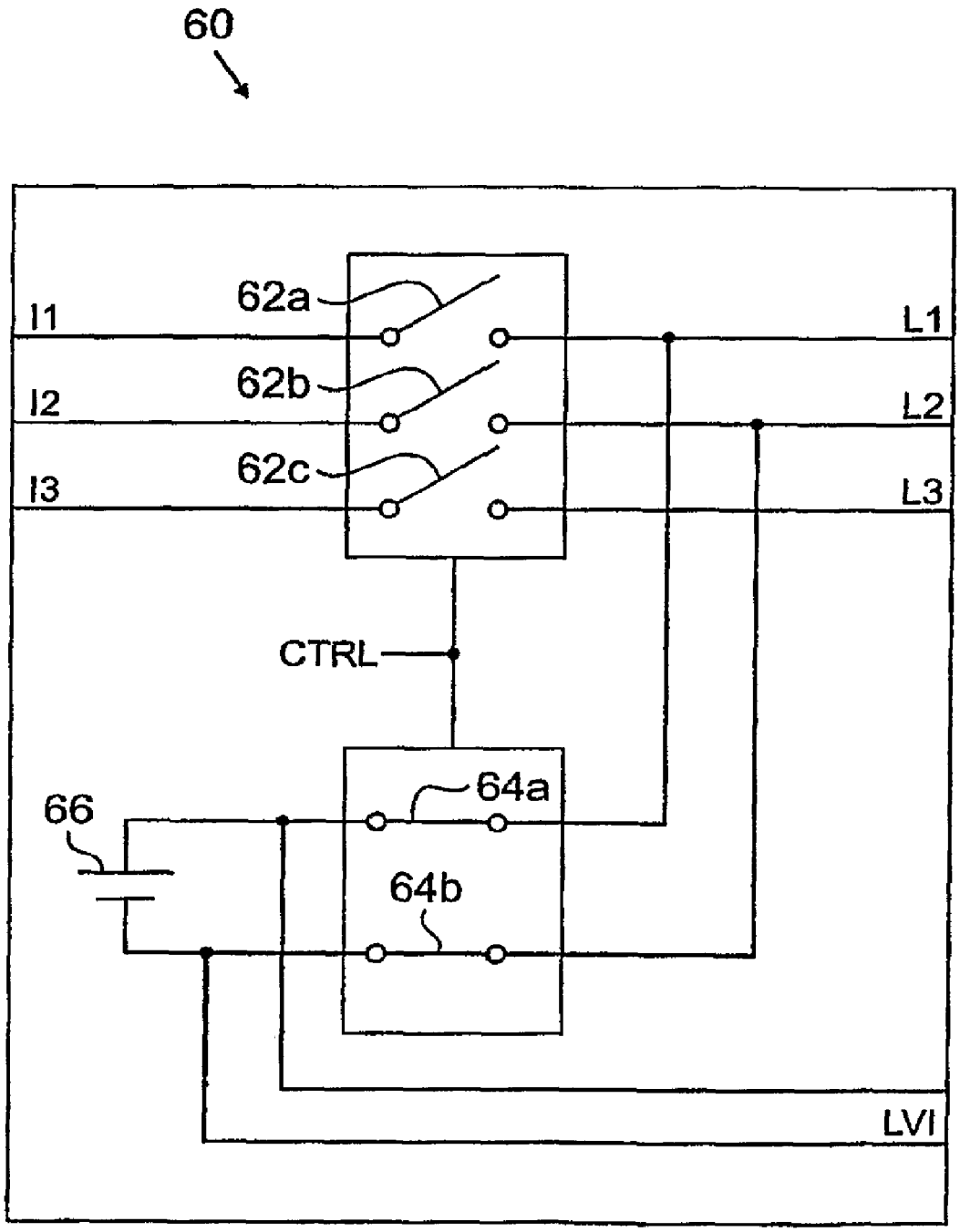
FIG. 3 is a schematic view of an H-bridge rescue operation circuit for switching from a main power supply to a backup power supply.

FIG. 3 is a schematic view of rescue operation circuit 60 according to another embodiment of the present invention. Rescue operation circuit 60 is another example of a circuit that may be used for rescue operation circuit 22 shown in FIG. 1. Rescue operation circuit 60 includes main power switches 62*a*, 62*b*, and 62*c*, backup power switches 64*a* and 64*b*, and battery 66. Main power relay switch 62*a* is connected between input I1 and output line L1, main power relay switch 62*b* is connected between input I2 and output line L2, and main power relay switch 62*c* is connected between input I3 and output line L3. Backup power relay switch 54*a* is connected between the positive pole of battery 66 and output line L1, and backup power relay switch 54*b* is connected between the negative pole of battery 66 and output line L2. Backup power switches 54*a* and 54*b* are arranged to form an H-bridge across output lines L1 and L2. The low voltage inputs (LVI) of SMPS 34 are also connected across battery 56. In an alternative embodiment, the negative pole of battery 66 is also connected to the common node DC− of the regenerative drive.

If the measured voltage of main power supply 20 is within the normal operating range of power system 10, control block 40 provides a signal to rescue operation circuit 60 via line CTRL that simultaneously closes main power switches 62*a*-62*c* and opens backup power switches 64*a* and 64*b*. This connects the three phases of main power supply 20 on inputs I1, I2, and I3 to output lines L1, L2, and L3, respectively. As a result, power system 10 (FIG. 1) is powered by main power supply 20 during normal operating conditions.

If the measured voltage of main power supply 20 drops below the normal operating range of power system 10, control block 40 provides a signal to rescue operation circuit 60 via line CTRL that simultaneously opens main power switches 62*a*-62*c* and closes backup power switches 64*a* and 64*b*. This connects the positive pole of battery 66 to output line L1 and the negative pole of battery 66 to output line L2. SMPS 34 is powered via lines LVI from battery 66 to continuously power the drive control system and the auxiliary systems during the transition from main power supply 20 to battery 66. In this embodiment, power converter 26 functions as a single boost converter to provide stepped-up DC power from battery 66 to power bus 28. The configuration shown is capable of providing DC power from battery 56 on power bus 28 that is on the order of 1.5 to two times the voltage of battery 66. This configuration is suitable for elevator 14 having lower power demand and provides the advantage of not requiring an additional electrical connection of the negative pole of battery 66 to common node DC−.

In summary, the subject invention is directed to a system for continuously driving an elevator hoist motor during normal and power failure conditions. A regenerative drive delivers power from a main power supply to the hoist motor during normal operation. A rescue operation circuit includes a backup power supply and is operable in the event of a failure of the main power supply to disconnect the regenerative drive from the main power supply and connect the backup power supply to the regenerative drive to provide substantially uninterrupted power to the hoist motor. The system of the present invention provides increased performance of the regenerative drive powered from the backup power source compared with prior systems, and allows for a fast transition from the main power supply to the backup power supply upon detection of failure of the main power supply.

Although the present invention has been described with reference to examples and preferred embodiments, workers skilled in the art will recognize that changes may be made in form and detail without departing from the spirit and scope of the invention.

The invention claimed is:

1. A system for continuously driving an elevator hoist motor during normal and power failure conditions, the system comprising:

a regenerative drive for delivering power to the hoist motor, the regenerative drive having inputs for receiving power from a main power supply during normal operation; and a rescue operation circuit including a backup power supply that is operable in the event of a failure of the main power supply to simultaneously disconnect the inputs of the regenerative drive from the main power supply and connect the backup power supply to the inputs of the regenerative drive to supply DC power to the inputs.

2. The system of claim 1, wherein the rescue operation circuit comprises:

a first set of switches connected between the main power supply and the inputs of the regenerative drive; and a second set of switches connected between the backup power supply and the inputs of the regenerative drive, wherein the first switch set of switches is closed and the second set of switches is opened during normal operation, and wherein the first set of switches is opened and the second set of switches is closed during failure of the main power supply.

3. The system of claim 2, wherein states of the first set of switches and the second set of switches are a function of a sensed main power supply voltage.

4. The system of claim 2, wherein the first set of switches comprises three switches to deliver three-phase power from the main power supply to the inputs of the regenerative drive during normal operation.

5. The system of claim 4, wherein the second set of switches comprises three switches each connected between an input line of the three-phase regenerative drive and the backup power supply.

6. The system of claim 4, wherein the second set of switches comprises a first switch connected between a positive pole of the backup power supply and a first input of the three-phase regenerative drive and a second switch connected between a negative pole of the backup power supply and a second input of the three-phase regenerative drive.

7. The system of claim 2, wherein the first and second sets of switches are comprised of devices selected from the group consisting of relays and transistors.

8. The system of claim 1, and further comprising:

a switch mode power supply device for switching power to auxiliary and control systems from the main power supply to the backup power supply upon failure of the main power supply to provide substantially uninterrupted power to the auxiliary and control systems.

9. The system of claim 1, wherein the backup power supply comprises at least one battery.

10. The system of claim 1, wherein the regenerative drive comprises:

a converter to convert power received at the inputs of the regenerative drive from the main power supply into direct current (DC) power;

an inverter to drive the hoist motor by converting the DC power from the converter into AC power and, when the hoist motor is generating, to convert AC power produced by the hoist motor to DC power; and a power bus connected between the converter and the inverter to receive DC power from the converter and the inverter.

11. The system of claim 10, wherein the converter boosts power from the backup power supply during the power failure condition and delivers the boosted power to the power bus.

12. An elevator drive system comprising:

a regenerative drive having outputs connected to an elevator hoist motor and having inputs connected to a main power supply of AC power by a first set of switches and a backup power supply of DC power by a second set of switches;

a voltage sensor for measuring a main power supply voltage; and a controller for closing the first set of switches and opening the second set of switches if the measured main power supply voltage is within a normal operating range, and for opening the first set of switches and closing the second set of switches if the measured main power supply voltage is below the normal operating range.

13. The elevator drive system of claim 12, wherein the first set of switches comprises three switches to deliver three-phase power from the main power supply to the regenerative drive if the measured main power supply voltage is within the normal operating range.

14. The elevator drive system of claim 13, wherein the second set of switches is arranged in a three-phase bridge configuration.

15. The elevator drive system of claim 13, wherein the second set of switches is arranged in an H-bridge configuration.

16. The elevator drive system of claim 13, wherein the backup power supply comprises at least one battery.

17. The elevator drive system of claim 12, wherein the regenerative drive comprises:

a converter to convert power received at inputs of the regenerative drive from the main power supply or the backup power supply into direct current (DC) power;

an inverter to drive the hoist motor by converting the DC power from the converter into AC power and, when the hoist motor is generating, to convert AC power produced by the hoist motor to DC power; and a power bus connected between the converter and the inverter to receive DC power from the converter and the inverter.

18. The elevator drive system of claim 17, wherein the converter boosts power from the backup power supply if the measured main power supply voltage is below the normal operating range and delivers the boosted power to the power bus.

19. A method for providing substantially uninterrupted power to an elevator hoist motor during normal and power failure conditions of a main power supply, the method comprising:

measuring a main power supply voltage;

connecting the main power supply to inputs of a regenerative drive that drives the elevator hoist motor if the measured main power supply voltage is within a normal operating range; and disconnecting the main power supply from the inputs of the regenerative drive and connecting a backup power supply to the inputs of the regenerative drive if the measured main power supply voltage is below the normal operating range, wherein the main power supply provides AC power to the inputs, and the backup power supply provides DC power to the inputs.

20. The method of claim 19, wherein connecting the main power supply comprises closing a first set of switches connected between the main power supply and the inputs of the regenerative drive and opening a second set of switches connected between the backup power supply and the inputs of the regenerative drive.

21. The method of claim 20, wherein the disconnecting step comprises opening the first set of switches and closing the second set of switches.

22. The method of claim 20, wherein the second set of switches is arranged in a configuration selected from the group consisting of a three-phase bridge configuration and an H-bridge configuration.

23. The method of claim 19, wherein the backup power supply comprises at least one battery.

24. The method of claim 19, and further comprising:

boosting power from the backup power supply with the regenerative drive if the measured main power supply voltage is below the normal operating range.

* * * * *

UNITED STATES PATENT AND TRADEMARK OFFICE

CERTIFICATE OF CORRECTION

PATENT NO. : 8,146,714 B2
APPLICATION NO. : 12/519282
DATED : April 3, 2012
INVENTOR(S) : Vladimir Blasko It is certified that error appears in the above-identified patent and that said Letters Patent is hereby corrected as shown below:

Col. 6, Line 64
Delete "line"

Signed and Sealed this
Seventeenth Day of July, 2012

David J. Kappos

David J. Kappos
*Director of the United States Patent and Trademark Office*